US006540550B2

(12) United States Patent
Chang et al.

(10) Patent No.: US 6,540,550 B2
(45) Date of Patent: Apr. 1, 2003

(54) STACKED CARD EDGE CONNECTOR

(75) Inventors: Wei Sun Chang, Taipei (TW); Pei-Cheng Chao, Taipei (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/952,672

(22) Filed: Sep. 11, 2001

(65) Prior Publication Data

US 2002/0081897 A1 Jun. 27, 2002

(51) Int. Cl.[7] ..... H01R 13/60

(52) U.S. Cl. ..... 439/541.5; 439/326; 439/328

(58) Field of Search ..... 439/541.5, 326, 439/328

(56) References Cited

U.S. PATENT DOCUMENTS 4,747,790 A * 5/1988 Masuda et al. ..... 439/326
4,756,694 A * 7/1988 Billman et al. ..... 439/328

* cited by examiner

*Primary Examiner*—Tho D. Ta
(74) *Attorney, Agent, or Firm*—Thomas D. Paulius

(57) ABSTRACT

A card edge connector assembly is provided for electrically connecting at least a pair of stacked memory cards to a circuit board. The assembly includes a lower connector having a dielectric housing mounting a plurality of conductive terminals along a slot for receiving an edge of a lower memory card. An upper connector has a dielectric housing mounting a plurality of conductive terminals along a slot for receiving an edge of an upper memory card at an angle to the lower memory card, the angle diverging in a direction away from said slots.

13 Claims, 2 Drawing Sheets

STACKED CARD EDGE CONNECTOR

BACKGROUND OF THE INVENTION

This invention generally relates to the art of electrical connectors and, particularly, to a card edge connector assembly for electrically connecting at least a pair of stacked memory cards.

Memory modules, or memory cards have been used extensively due to the need for high memory capacity in computer systems and other applications. Connectors for such memory cards typically are mounted on a circuit board, such as a motherboard. In order to increase capacities, such connectors often are stacked on top of each other to conserve space or "real estate" on the circuit board.

For instance, FIG. 1 illustrates a tandem edge card connector assembly, generally designated 10, for receiving two memory modules or cards, as disclosed in ROC Patent No. 370290. The connector assembly includes a lower connector 12, and an upper connector 14 that overlies the lower connector. The lower and upper connectors receive a pair of stacked memory or edge cards 16 and 18, respectively.

More particularly, lower connector 12 includes a housing 20 mounting a plurality of conductive terminals 22 along an elongated slot 24. A pair of arms 26 project forwardly of housing 20 at opposite ends of slot 24.

Although not shown in FIG. 1, it is well known that the terminals 22 are designed for receiving a memory card, such as lower memory card 16, at an angle with zero insertion forces. The memory card is then tilted or rotated downwardly so that the terminals apply pressure to the conductors on the memory card. In FIG. 1, it can be seen that memory card 16 is at an angle for insertion into slot 24 of housing 20 of lower connector 12. Once fully inserted into the slot, the memory card 16 is rotated downwardly until notches 28 in opposite side edges of the card 16 interengage with the bosses 30 that project inwardly of the arms 26. The memory card 16 then is held between the engagement arms in an orientation that is generally parallel to the circuit board on which connector assembly 10 is mounted.

The upper connector 14 also includes a housing 32 that supports a plurality of terminals 34 along a slot 36. A pair of arms 38 project forwardly of the housing 32 at opposite ends of the slot 36. As seen clearly in FIG. 1, the housing 32 has a downwardly offset portion 32*a* so that upper connector 14 nests on top of and behind lower connector 12, with arms 38 of the upper connector partially overlying arms 26 of the lower connector.

As with the lower connector, upper memory card 18 is inserted into slot 36 of upper connector 14 at an angle with zero insertion forces. The upper memory card then is tilted or rotated downwardly until notches 28 at opposite side edges of the card interengage with bosses 30 projecting inwardly from arms 38 of the upper connector.

Although electrical connector assembly 10 of the prior art allows insertion of two memory cards 16 and 18 therein, to conserve space on the circuit board, it can be seen in FIG. 1 that upper connector 14 is staggered above and rearwardly relative to lower connector 12. The upper connector 14 is shifted horizontally rearwardly so that arms 38 of the upper connector do not completely block arms 26 of the lower connector. This staggered relationship of the two connectors is required so that the upper memory card 18 does not interfere with lower memory card 16 when the lower memory card is inserted or removed from lower connector 12 while upper memory card 18 is fully inserted into upper connector 14. If the upper connector 14 was mounted directly on top of, or vertically aligned with lower connector 12, an inserted upper memory card 18 would make it difficult to remove the lower memory card 16 without possibly damaging one or both of the cards or it would require a user to remove the top edge card just in order to gain access to and remove or insert the bottom edge card. Therefore, prior art connectors as shown in FIG. 1 must have upper connector 14 shifted horizontally or staggered rearwardly relative to lower connector 12, as shown. The problem with such staggered arrangements is that connector assembly 10 takes up too much horizontal space or "real estate" on the circuit board. Additionally, the short heights of the connectors compared to the long lengths of the connectors, the length of the connectors must be extended a large distance in order to accommodate the rotational insertion/removal movement of the cards. This large space takes up space on the circuit board that could otherwise be used for other electronic components.

The present invention is directed to a stacked card edge connector assembly that overcomes the aforementioned disadvantages.

SUMMARY OF THE INVENTION

An object, therefore, of the invention is to provide a new and improved card edge connector assembly for electrically connecting at least a pair of stacked memory cards, such as on a circuit board.

Another object of the present invention is to provide an improved, stacked edge card connector assembly for mounting a pair of edge cards, in which the edge cards are mounted in a manner so that the insertion/removal of one of the two edge cards does not interfere with the insertion/removal of the other edge card.

A further object of the present invention is to provide a stacked edge card connector in which two card connectors are stacked on each other and are oriented with respect to each other at an oblique angle so that one of the two cards can be inserted or removed from its connector without requiring the insertion or removal of the other of the two cards.

In the exemplary embodiment of the invention, the connector assembly includes a lower connector having a dielectric housing supporting a plurality of conductive terminals along a slot for receiving an edge of a lower memory card. An upper connector is provided with a dielectric housing also supporting a plurality of conductive terminals along a slot for receiving an edge of an upper memory card at an angle to the lower memory card, the angle diverging in a direction away from the slots.

According to one principal aspect of the present invention, the housings and the respective slots of the lower and upper connectors are generally in vertical alignment above the circuit board. The lower memory card is received in the lower connector generally parallel to the circuit board on which the connector assembly is mounted. The angle of the upper memory card is inclined upwardly relatively to the circuit board. In the preferred embodiment, the assembly includes a one-piece connector body defining the two housings of both the lower and upper connectors.

According to another aspect of the invention, a pair of arms project from the housing of each of the lower and upper connectors at opposite ends of the respective slot thereof and between which the memory cards are inserted into the slots. The arms of the upper connector project at an angle relative to the arms of the lower connector. The arms are flexible, and a strain relief member is provided to limit flexing of the arms. The arms and the respective housings are fabricated of plastic material, and the strain relief member is fabricated of metal material and includes a foot portion for securing, as by soldering, to the circuit board.

Other objects, features and advantages of the invention will be apparent from the following detailed description taken in connection with the accompanying drawings.

BRIEF DESCRIPTION OF THE DRAWINGS

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENT

Figure 2:
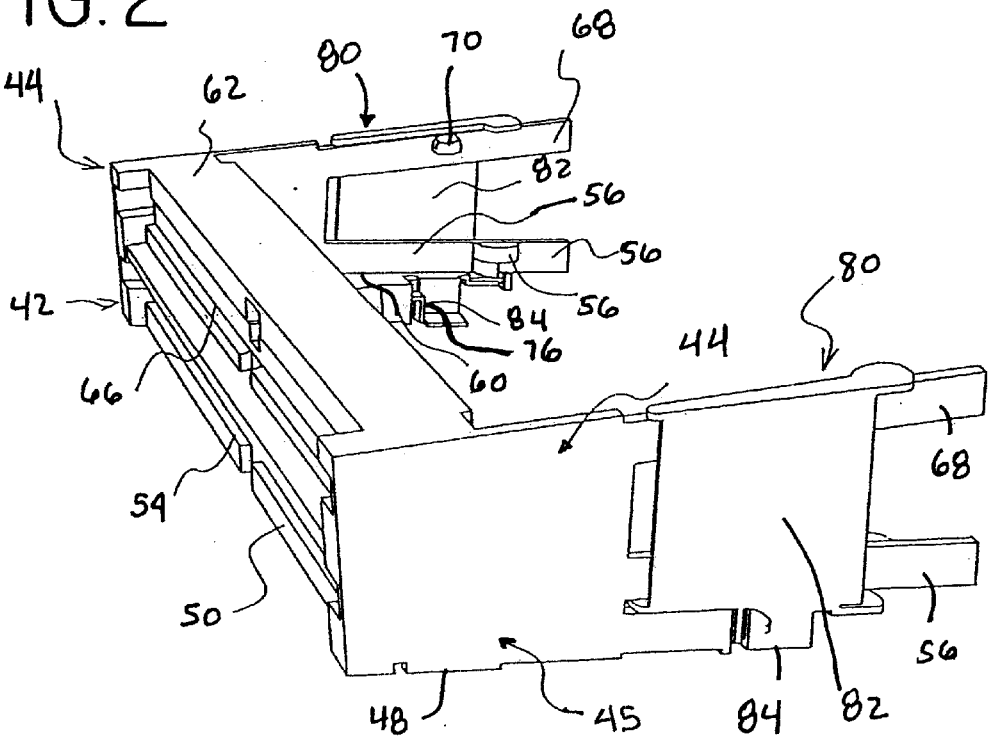
FIG. 2 is a side perspective view of a card edge connector assembly constructed in accordance with the principles of the present invention.
Figure 3:
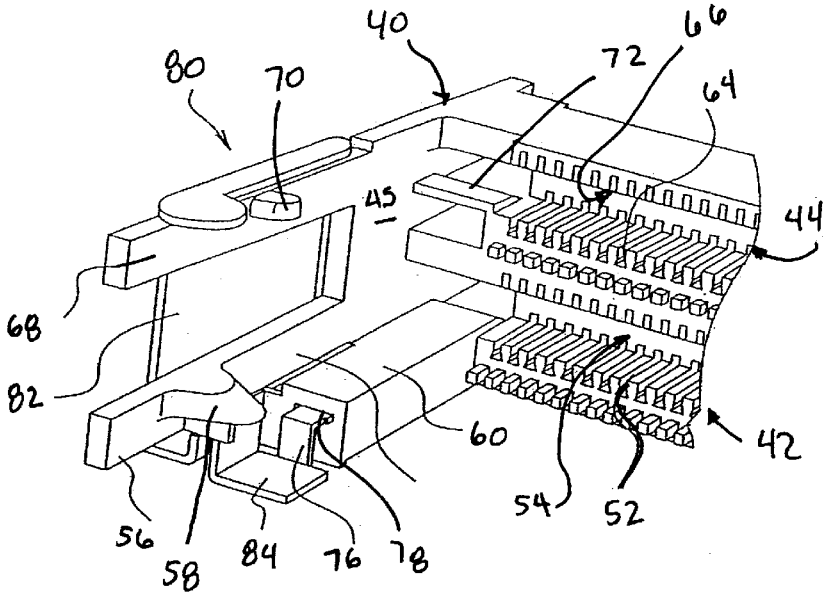
FIG. 3 is a partial perspective view taken from the front of the connector assembly and looking inwardly toward the left-hand arms of the connectors assembly.

Referring to the drawings in greater detail, and first to FIGS. 2 and 3, the invention is embodied in a stacked card edge connector assembly, generally designated 40, which includes a lower connector 42 and an upper connector 44. The lower and upper connectors are designed for receiving lower and upper memory modules or cards 46 and 48 (FIG. 4), respectively, in a vertical stacked array.

Lower connector 42 and upper connector 44 may be separate, or independent connectors. However, in the preferred embodiment illustrated, the housings of the two connectors are integral portions of a one-piece connector body 46, which may be unitarily molded of dielectric material such as plastic or the like. The body 45 has a bottom mounting surface 48 for mounting the entire connector assembly 40 on a circuit board. It will be understood that in the following description, the terms "upper" and "lower" are for reference to the embodiment illustrated and are not to be considered as limiting.

The lower connector 42 includes a dielectric housing portion 50 which mounts a plurality of conductive terminals 52 along an elongated slot 54 for receiving lower memory card 46. A pair of flexible engagement arms 56 project outwardly of housing 50 in line with slot 54 at opposite ends thereof. Each engagement arm has an inwardly projecting boss 58 for engaging an edge card. Horizontal platforms 60 project forwardly at opposite ends of slot 54 slightly below the flexible arms 56.

The upper connector 44 includes a housing 62 mounting a plurality of conductive terminals 64 along an elongated slot 66. Another pair of flexible engagement arms 68 project forwardly of the housing at opposite ends of the slot, and the arms 68 have inwardly projecting bosses 70. A pair of horizontal platforms 72 (FIG. 3) are provided at opposite ends of slot 66.

Figure 1:
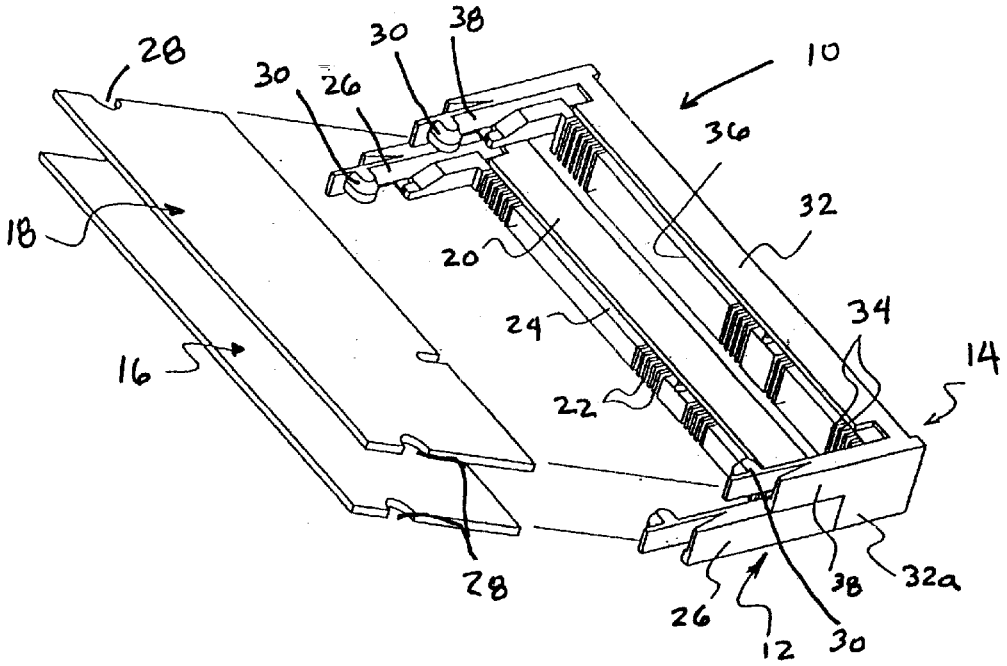
FIG. 1 (Prior Art)
FIG. 1 is a perspective view of a stacked card edge connector assembly according to the prior art, in conjunction with a pair of memory cards.
Figure 4:
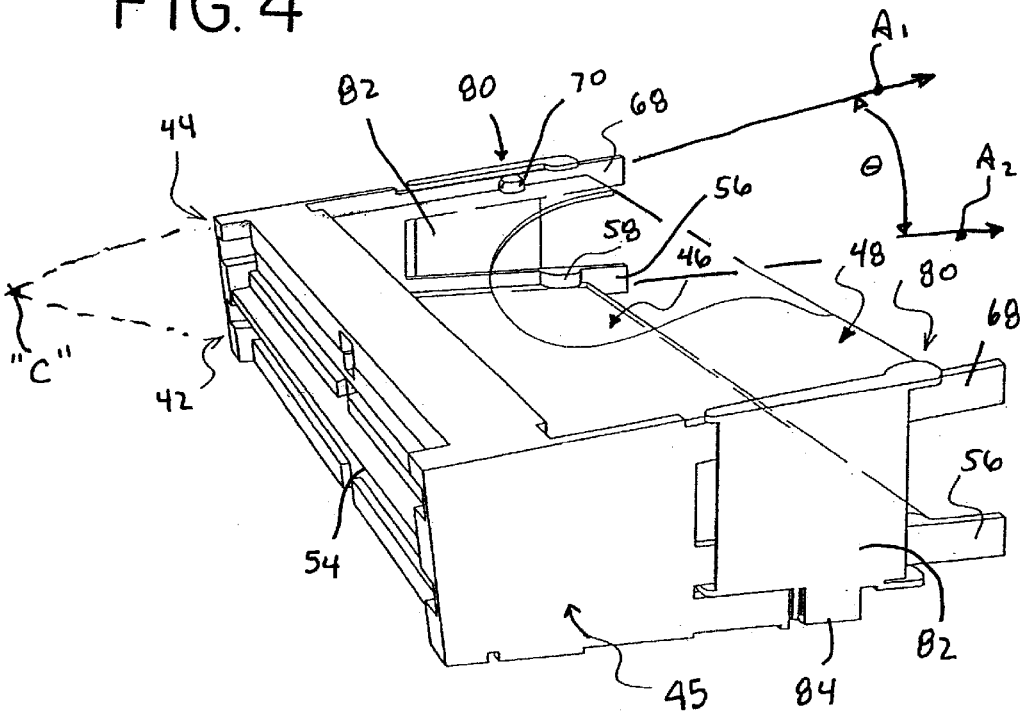
FIG. 4 is a view similar to that of FIG. 2, with a pair of memory cards inserted into the connector assembly.

In order to solve the problems of the prior art as described in detail above and as illustrated in FIG. 1, it can be seen in the drawings that the upper connector 44, including its slot 66 and arms 68, is oriented at an angle to lower connector 42, including its slot 54 and arms 56 so that the planes of the respective slots in which the edge cards 16, 18 lie when engaged with the two connectors are non-parallel. The two planes cooperatively define an included angle which as illustrated in FIG. 4, defined between two imaginary lines $A_1$ and $A_2$ which extend through the planes of the cards. If these two lines $A_1$, $A_2$ are extended to the rear of the connector assembly (or to the left of FIG. 4), they would eventually intersect at point "C". The lower connector slot 54 and arms 56 may extend generally parallel to the circuit board on which connector assembly 40 is mounted, while the slot 66 and arms 68 of the upper connector 44 will be inclined upwardly relatively to the circuit board in a direction away from the slots. The plane of the lower connector card slot may be parallel to the circuit board or at a slight angle thereto. This diverging angle of the lower and upper connectors is effective to receive lower memory card 46 and upper memory card 48 at a diverging angle relative to each other as seen in FIG. 4. The lower and upper memory card each have notches (similar to the notches 28 in FIG. 1) in the side edges thereof for interengagement with bosses 58 and 70 of lower and upper arms 66 and 68, respectively.

With the two memory cards 46 and 48 diverging at an angle away from each other and the connectors 42 and 44 and their respective slots 54 and 66, the vertical spacing between the outer edges of the memory cards is significantly increased. This allows lower memory card 46 to be tilted upwardly and manipulated into and out of its respective slot 54 without interference with the upper memory card 48 inserted into its respective connector slot 66. There will be no interference with no damage to the other memory card.

Finally, FIGS. 2 and 3 show that a pair of mounting feet 76 are press-fit into holes 78 in the connector body 46. These mounting feet may be are fabricated of metal material and can be secured, as by soldering, to mounting pads on the circuit board. In addition, a metal strain relief member, generally designated 80, is positioned about flexible arms 56 and 68 at opposite sides of the connector assembly. The strain relief member has a vertically oriented plate portion 82 which provides a backing for arms 56 and 68 to limit flexing of the arms. The strain relief members have mounting feet 84 for securing, as by soldering, to appropriate mounting pads on the circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A dual edge card connector for connecting at least two edge cards to a circuit board, comprising:

a first connector housing formed from an insulative material and having a first elongated slot extending between two opposing ends thereof, the first housing including a first pair of engagement arms extending outwardly from the first connector housing, said first slot and said first engagement arms cooperatively defining a first receptacle for receiving a first of said two memory cards and orienting said first memory card in place within a first plane;

a second connector housing formed from an insulative material and having a second elongated slot extending between two opposing ends thereof, one second housing including a second pair of engagement arms extending outwardly from the second connector housing, said second slot and second engagement arms cooperatively defining a second receptacle for receiving a second of said two memory cards therein and orienting the second memory cards therein and orienting the second memory card in a second plane distinct from such first plane;

said first and second slots being said separated from each other by a preselected included angle such that said first and second planes are also separated by said included angle; and, a pair of retainers disposed on opposite ends of said connector, each retainer including a metal shield that limits side movement of said first and second pairs of engagement arms during insertion and removal of said memory cards from said connector housing slots.

2. The dual edge card connector as claimed in claim 1, wherein said first and second connector housings are defined within a single connector body.

3. The dual edge card connector as claimed in claim 1, further including engagement members formed on said first and second engagement arms for engaging edges of said first and second memory cards when inserted into said first and second slots.

4. The dual edge card connector as claimed in claim 1, wherein said first slot of said first connector housing is oriented in a plane parallel to a circuit board said connector is mounted to.

5. The dual edge card connector as claimed in claim 1, wherein said first connector housing is stacked above said second connector housing.

6. The dual edge card connector as claimed in claim 5, wherein said first and second connector housing slots are vertically aligned with each other.

7. A card edge connector assembly for electrically connecting at least a pair of stacked memory cards to a circuit board, comprising:

a first connector portion including a first slot disposed therein for receiving an edge of a first memory card therein, the first connector portion supporting a plurality of conductive first terminals along the first slot, and a pair of first engagement arms spaced apart from each other at opposite ends of said first slot; and, a second connector portion including a second slot disposed therein for receiving an edge of a second memory card therein, the second connector portion supporting a plurality of conductive second terminals along the second slot, said second connector portion further including a pair of second engagement arms spaced apart from each other and disposed of opposite ends of said second slot, the first and second slots being oriented within said connector assembly so as to define an included angle therebetween, such that when first and second memory cards are respectively inserted into said first and second connector housing slots, they are separated from each other by said included angle; and, a pair of strain relief members disposed on opposite sides of said first and second connector portions, the strain relief members limiting flexing of said first and second engagement arms.

8. The card edge connector of claim 7, wherein said first and second connector portions are formed within a single connector body.

9. The card edge connector of claim 7, wherein said first and second connector portions are vertically aligned with each other above the circuit board.

10. The card edge connector of claim 7, wherein said first and second slots are vertically aligned with each other above said circuit board.

11. The card edge connector of claim 7, wherein said first and second engagement arms are separated from each other by said included angle.

12. The card edge connector of claim 7, wherein said first and second engagement arms are formed from a plastic and said strain relief members are formed of metal.

13. The card edge connector of claim 7, wherein said first slot is generally parallel to said circuit board and said second slot is spaced apart from said first slot by said included angle.

* * * * *